US008020864B1

(12) United States Patent
Tharayil et al.

(10) Patent No.: US 8,020,864 B1
(45) Date of Patent: Sep. 20, 2011

(54) PRINTING SYSTEM AND METHOD USING ALTERNATING VELOCITY AND TORQUE CONTROL MODES FOR OPERATING ONE OR MORE SELECT SHEET TRANSPORT DEVICES TO AVOID CONTENTION

(75) Inventors: Marina Tharayil, Rochester, NY (US); Barry P. Mandel, Fairport, NY (US); Joannes N. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/788,538

(22) Filed: May 27, 2010

(51) Int. Cl.
*B65H 5/34* (2006.01)

(52) U.S. Cl. ..... 271/270; 271/265.01

(58) Field of Classification Search ..... 271/270, 271/265.01, 258.01, 264, 272
See application file for complete search history.

(56) References Cited

U.S. PATENT DOCUMENTS

| | | | | |
|---|---|---|---|---|
| 3,991,992 | A | 11/1976 | Randall et al. | |
| 4,687,925 | A | 8/1987 | Huggins | |
| 5,120,977 | A | 6/1992 | Dragon et al. | |
| 5,150,115 | A | 9/1992 | deJong et al. | |
| 5,241,525 | A | 8/1993 | Taylor | |
| 5,592,278 | A * | 1/1997 | Sato et al. | 399/384 |
| 5,836,580 | A | 11/1998 | Hansen et al. | |
| 5,838,338 | A | 11/1998 | Olson | |
| 6,032,004 | A | 2/2000 | Mirabella, Jr. et al. | |
| 6,400,913 | B1 | 6/2002 | deJong et al. | |
| 7,305,200 | B2 | 12/2007 | Hoffman et al. | |
| 7,457,557 | B2 | 11/2008 | Roof et al. | |
| 7,512,377 | B2 * | 3/2009 | Choi et al. | 399/396 |
| 7,673,876 | B1 * | 3/2010 | DeGruchy | 271/264 |
| 7,931,274 | B2 * | 4/2011 | Krucinski | 271/264 |
| 2003/0108369 | A1 | 6/2003 | Kuo et al. | |
| 2004/0065994 | A1 | 4/2004 | Halvonik et al. | |
| 2005/0074267 | A1 | 4/2005 | Demchock et al. | |

(Continued)

FOREIGN PATENT DOCUMENTS

EP 1054302 A2 11/2000

OTHER PUBLICATIONS

Atwood et al., U.S. Appl. No. 12/361,751, filed Jan. 29, 2009. http://www.algebralab.org/lessons/lessons.aspx?file=Trigonometry_TrigAngLinVelocity.xml. 2003-2009.
http://en.wikipedia.org/wiki/Servomechanism, 2009.
U.S. Appl. No. 12/363,819, Notice of Allowance, Dec. 23, 2009, 3 pages.
Krucinski et al., U.S. Appl. No. 12/475,105, filed May 29, 2009.

*Primary Examiner* — Kaitlin S. Joerger
*Assistant Examiner* — Prasad Gokhale
(74) *Attorney, Agent, or Firm* — Gibb I.P. Law Firm, LLC

(57) ABSTRACT

A printing system and method using alternating control modes for one or more, but not all, sheet transport devices in order to avoid contention. In a printer having first, second and third sheet transport devices in series (e.g., registration, image transfer and image fixing devices), the second device can always operate in a velocity control mode. However, the first and/or third devices can alternate between velocity and torque control modes. For example, the first device can operate in a torque control mode, when a sheet is concurrently engaged by both the first and second devices, and in a velocity control mode at other times. Additionally or alternatively, the third device can operate in a torque control mode, when a sheet is concurrently engaged by both the second and third devices, and in a velocity control mode at other times. Transition control modes can be implemented to generate smooth transitions between modes.

23 Claims, 5 Drawing Sheets

U.S. PATENT DOCUMENTS

| | | | | |
|---|---|---|---|---|
| 2005/0156374 | A1 | 7/2005 | Siegel et al. | |
| 2006/0222378 | A1 | 10/2006 | Julien | |
| 2007/0222142 | A1 | 9/2007 | Owen | |
| 2008/0012214 | A1 | 1/2008 | Elliot | |
| 2008/0012215 | A1 | 1/2008 | Elliot | |
| 2008/0136092 | A1 | 6/2008 | Elliot | |
| 2008/0150218 | A1 | 6/2008 | Clark et al. | |
| 2008/0258382 | A1 | 10/2008 | deJong et al. | |
| 2008/0260445 | A1 | 10/2008 | Costanza et al. | |
| 2010/0301548 | A1* | 12/2010 | Krucinski | 271/264 |
| 2011/0064496 | A1* | 3/2011 | Ashikawa | 399/361 |
| 2011/0148035 | A1* | 6/2011 | Yamamoto et al. | 271/265.02 |

* cited by examiner

PRINTING SYSTEM AND METHOD USING ALTERNATING VELOCITY AND TORQUE CONTROL MODES FOR OPERATING ONE OR MORE SELECT SHEET TRANSPORT DEVICES TO AVOID CONTENTION

BACKGROUND

Embodiments herein generally relate to printing systems and methods. More particularly, the embodiments relate to a printing system and method using alternating velocity and torque control modes for operating one or more select sheet transport devices (e.g., a registration nip and/or an image fixing nip) to avoid contention (e.g., with a velocity controlled image transfer nip).

Generally, printing devices incorporate multiple independently driven sheet transport devices (e.g., nips and electrostatic transport belts) for transporting a print media sheet (e.g., a sheet of paper) along a sheet transport path. Oftentimes, these sheet transport devices not only transport a print media sheet but are integral components in other printing operation functions (e.g., sheet registration, image transfer, image fixing, etc.). Thus, velocity matching can become critical in order to avoid image quality disturbances (e.g., shearing, banding, etc.) due to errors, such as registration errors, image on image transfer errors, etc. Current transport device drive schemes typically try to minimize these errors by independently controlling the rotation of each sheet transport device drive roller using a discrete servomechanism. Such a servomechanism monitors sheet velocity (i.e., linear velocity) as a print media sheet is transported by a corresponding sheet transport device and, based on this monitoring, adjusts, with a very tight tolerance, the power supplied to the drive motor which rotates the drive roller in order to achieve a predetermined constant sheet velocity or, alternatively, a predetermined varying sheet velocity profile. In other words, current transport device drive schemes typically operate in a velocity control mode.

Unfortunately, when a single print media sheet is concurrently engaged by multiple independently driven adjacent sheet transport devices (e.g., a registration nip and an image transfer nip, an image transfer nip and an image fixing nip, or a registration nip, an image transfer nip and an image fixing nip), velocity discrepancies between the drive rollers of the devices will cause contention between their corresponding servomechanisms. As a result, a sheet velocity mismatch can occur between the leading edge of a print media sheet and the trailing edge of that same print media sheet at a given point along the sheet transport path. This mismatch can be caused not only by spiking drive roller velocity changes during transitions into and out of contention but also by servomechanisms essentially fighting for velocity control, during contention. Thus, consider a print media sheet being transported along a sheet transport path through a registration nip, a transfer nip and an image fixing nip in series. Since the print media sheet may be engaged by more than one of these nips at a time such that their servomechanisms move in and out of contention, there may be a sheet velocity mismatch between the leading and trailing edges of the print media sheet at the image transfer point. Such a mismatch can result in the same image disturbances (e.g., shearing, banding, etc.) due to the same errors (e.g., registration errors, image on image transfer errors, etc.) that the servomechanisms were designed to avoid.

SUMMARY

In view of the foregoing, disclosed herein are embodiments of printing system and method using alternating velocity and torque control modes for one or more, but not all, independently driven sheet transport devices in a sheet transport path in order to avoid contention. Specifically, in a printing system having first, second and third independently driven sheet transport devices in series (e.g., a registration device, an image transfer device and an image fixing device), the second sheet transport device (e.g., the image transfer device) can always operate in a velocity control mode. However, one or both of the other sheet transport devices (i.e., the immediately upstream and downstream devices) can alternate between operating in a velocity control mode and operating in a torque control mode. For example, the first sheet transport device (e.g., the registration device) can operate in the torque control mode, when a print media sheet is concurrently engaged by both the first and second sheet transport devices, and in a velocity control mode at all other times (e.g., when the print media sheet is not engaged by the second sheet transport device). Alternatively or additionally, the third sheet transport device (e.g., the image fixing device) can operate in the torque control mode, when the print media sheet is concurrently engaged by both the second and third sheet transport devices and in the velocity control mode at all other times (e.g., when the print media sheet is not engaged by the second sheet transport device). Thus, the second sheet transport device (e.g., the image transfer device) can always be the dominant sheet transport device for purposes of sheet velocity control, ensuring that contention is avoided.

More particularly, disclosed herein are embodiments of a printing system. The printing system can comprise at least three independently driven sheet transport devices (i.e., a first, a second and a third sheet transport device) in series along a sheet transport path. In one exemplary embodiment of the printing system, the first sheet transport device can comprise a registration device, the second sheet transport device can comprise an image transfer device, and the third sheet transport device can comprise an image fixing device. The printing system can further comprise one more controllers that control the second sheet transport device solely using a velocity control mode and that further control the first and/or the third sheet transport devices alternatingly using a velocity control mode and a torque control mode.

Specifically, a controller (e.g., a hybrid controller) can alternatingly operate the first sheet transport device in a velocity control mode and a torque control mode as the first sheet transport device receives a print media sheet, optionally processes the print media sheet and then transports the print media sheet to the second sheet transport device. For example, the controller can use the velocity control mode when the print media sheet has just been received by the first sheet transport device and is not yet engaged by the second sheet transport device. However, the controller can use the torque control mode (i.e., can switch the control mode) when the print media sheet is still engaged by the first sheet transport device and the leading edge has reached the second sheet transport device (i.e., when the print media sheet is concurrently engaged by both the first and second sheet transport devices).

Either the same hybrid controller or a different controller (e.g., a single mode controller) can operate the second sheet transport device solely in the velocity control mode as the second sheet transport device receives the print media sheet from the first sheet transport device, optionally processes the print media sheet and then transports the print media sheet to the third sheet transport device.

Either the same hybrid controller or a different controller (e.g., a different hybrid controller) can alternating operate the third sheet transport device in the torque control mode and the velocity control mode as the third sheet transport device receives the print media sheet from the second sheet transport device, optionally process the print media sheet and then transports the print media sheet to either an output tray or an additional sheet transport device for further processing. For example, the controller can use the torque control mode when the print media sheet is received by the third sheet transport device and still engaged by the second sheet transport device (i.e., when the print media sheet is concurrently engaged by both the second and third sheet transport devices). However, the controller can use the velocity control mode (i.e., can switch the control mode) when the print media sheet is no longer engaged by the second sheet transport device.

It should be noted that, in the velocity control mode, the controller(s) can cause drive roller angular velocity for the respective first, second or third sheet transport device to be selectively adjusted in order to achieve either a predetermined constant sheet velocity or a predetermined sheet velocity profile.

It should further be noted that, in the torque control mode, the controller(s) can cause any one of the following to occur: a constant set point level of torque to be applied to a drive roller of a respective first or third sheet transport device based on a previously measured and recorded level of torque applied to that drive roller during a velocity control mode; or a constant set point level of power to be supplied to a drive motor of a respective first or third sheet transport device based on a previously measured and recorded level of power supplied to that drive motor during a velocity control mode. Alternatively, in the torque control mode, the controller(s) can cause any one of the following to occur: a level of torque to be applied to a drive roller of a respective first or third sheet transport device based on a measured level of torque applied to the drive roller of the second sheet transport device; or a level of power to be supplied to a drive motor of a respective first or third sheet transport device based on a measured level of power supplied to the drive motor of the second sheet transport device. Alternatively, in the torque control mode, the controller(s) can cause either a varying level of torque to be applied to a drive roller of a respective first or third sheet transport device or a varying level of power to be supplied to a drive motor of the respective first or third sheet transport device so that a desired level of sheet tension is maintained at the second sheet transport device.

Optionally, the controller(s) can further control the first and/or the third sheet transport devices using a transition control mode when transitioning from the velocity control mode to the torque control mode and further when transitioning from the torque control mode to the velocity control mode.

Also disclosed herein are embodiments of a printing method for use with the above-described printing system. The method embodiments can comprise independently controlling multiple sheet transport devices that transport a print media sheet along a sheet transport path. The sheet transport devices can comprise a first sheet transport device (e.g., a sheet registration device), a second sheet transport device (e.g., an image transfer device) and a third sheet transport device (e.g., an image fixing device) in series. Furthermore, the process of independently controlling these sheet transport devices can comprise controlling the second sheet transport device solely using a velocity control mode and further controlling the first and/or the third sheet transport devices alternatingly using a velocity control mode and a torque control mode.

Specifically, the first sheet transport device can be controlled as the first sheet transport device receives a print media sheet, optionally process the print media sheet, and then transports that print media sheet to the second sheet transport device. The process of controlling of the first sheet transport device can comprise alternatingly using a velocity control mode and a torque control mode. For example, the velocity control mode can be used when the print media sheet has just been received by the first sheet transport device and is not yet engaged by the second sheet transport device. However, the torque control mode can be used (i.e., the control mode can be switched) when the print media sheet is still engaged by the first sheet transport device and the leading edge has reached the second sheet transport device (i.e., when the print media sheet is concurrently engaged by both the first and second sheet transport devices).

The second sheet transport device can be controlled as the second sheet transport device receives the print media sheet from the first sheet transport device, optionally processes the print media sheet, and then transports the print media sheet to the third sheet transport device. The process of controlling the second sheet transport device can comprise solely using a velocity control mode such that the second sheet transport device is always the dominant sheet transport device for purposes of sheet velocity control.

The third sheet transport device can be as the third sheet transport device receives the print media sheet from the second sheet transport device, optionally processes the print media sheet, and then transports the print media sheet to either an output tray or to an additional sheet transport device for further processing. The process of controlling of the third sheet transport device, like the process of controlling the first sheet transport device, can comprise alternatingly using the torque control mode and the velocity control mode. For example, the torque control mode can be used when the print media sheet is received by the third sheet transport device and still engaged by the second sheet transport device (i.e., when the print media sheet is concurrently engaged by both the second and third sheet transport devices). However, the velocity control mode can be used (i.e., the control mode can be switched) when the print media sheet is no longer engaged by the second sheet transport device.

It should be noted that, for each sheet transport device, using the velocity control mode comprises selectively adjusting drive roller angular velocity for the respective first, second or third sheet transport device in order to achieve either a predetermined constant sheet velocity or a predetermined sheet velocity profile.

It should further be noted that, for the first and third sheet transport devices, using the torque control mode can comprise any of the following: applying a constant set point level of torque to a drive roller of a respective first or third sheet transport device based on a previously measured and recorded level of torque applied to that drive roller during a velocity control mode; or supplying a constant set point level of power to a drive motor of a respective first or third sheet transport device based on a previously measured and recorded level of power supplied to that drive motor during a velocity control mode. Alternatively, using the torque control mode can comprise any of the following: applying a level of torque to a drive roller of a respective first or third sheet transport device based on a measured level of torque applied to the drive roller of the second sheet transport device; or supplying a level of power to a drive motor of a respective first or third sheet transport device based on a measured level of power supplied to the drive motor of the second sheet transport device. Alternatively, using the torque control mode can comprise either applying a varying level of torque to a drive roller of a respective first or third sheet transport device or supplying a varying level of power to the drive motor of the respective first or third sheet transport device so that a desired level of sheet tension is maintained at the second sheet transport device.

Optionally, the processes of controlling the first and/or the third sheet transport devices can comprise using a transition control mode when transitioning from the velocity control mode to the torque control mode and further when transitioning from the torque control mode to the velocity control mode.

Also disclosed herein are embodiments of a computer program product. This computer program product can comprise a computer usable medium having computer useable program code embodied therewith. The computer usable program code can be configured specifically to perform the above-described method.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
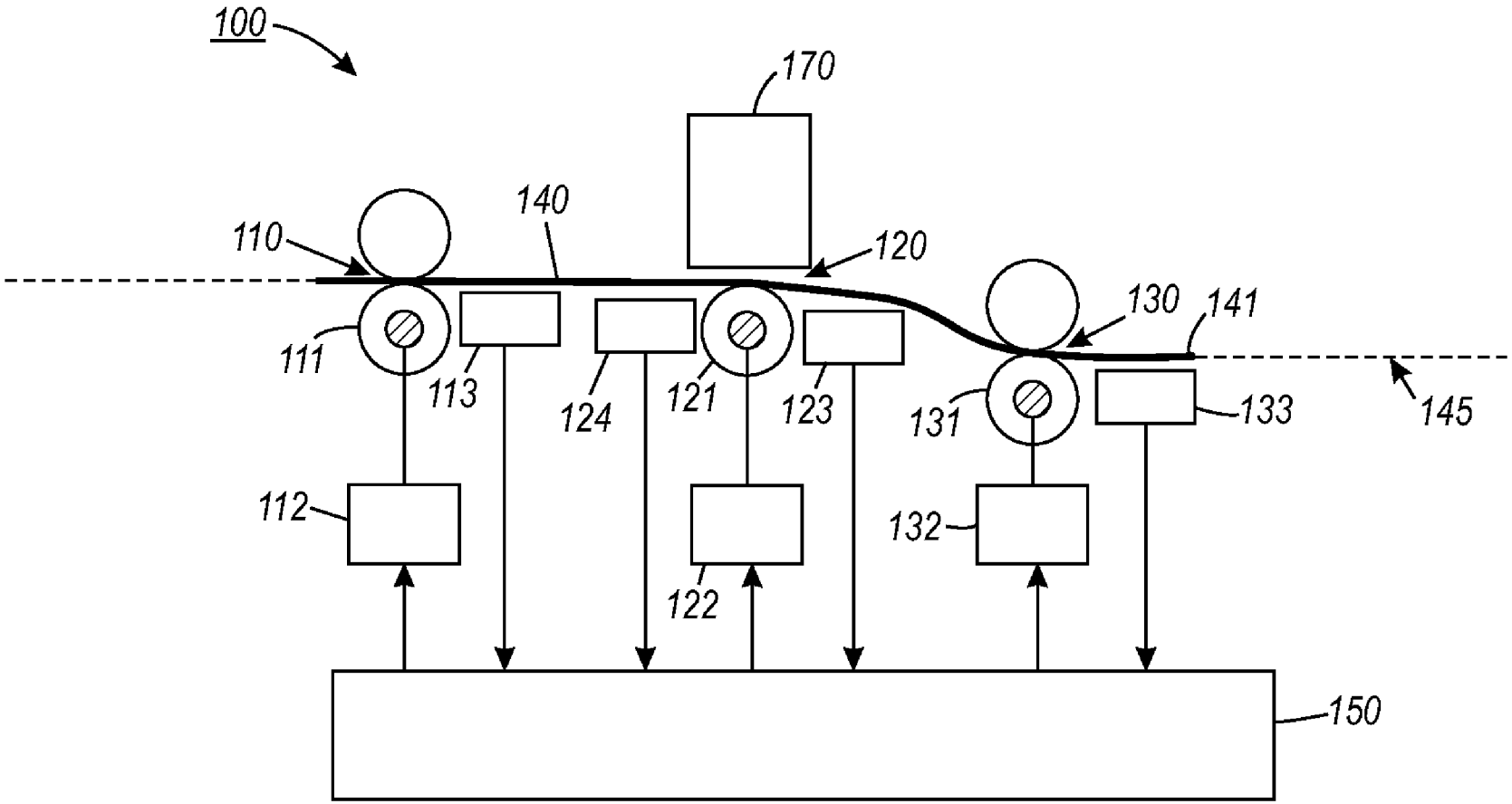
FIG. 1 is a schematic diagram illustrating an embodiment of a printing system.

As discussed above, generally, printing devices incorporate multiple independently driven sheet transport devices (e.g., nips and electrostatic transport belts) for transporting a print media sheet (e.g., a sheet of paper) along a sheet transport path. Oftentimes, these sheet transport devices not only transport a print media sheet but are integral components in other printing operation functions (e.g., sheet registration, image transfer, image fixing, etc.). Thus, velocity matching can become critical in order to avoid image quality disturbances (e.g., shearing, banding, etc.) due to errors, such as registration errors, image on image transfer errors, etc. Current transport device drive schemes typically try to minimize these errors by independently controlling the rotation of each sheet transport device drive roller using a discrete servomechanism. Such a servomechanism monitors sheet velocity (i.e., linear velocity) as a print media sheet is transported by a corresponding sheet transport device and, based on this monitoring, adjusts, with a very tight tolerance, the power supplied to the drive motor which rotates the drive roller in order to achieve a predetermined constant sheet velocity or, alternatively, a predetermined varying sheet velocity profile. In other words, current transport device drive schemes typically operate in a velocity control mode.

Unfortunately, when a single print media sheet is concurrently engaged by multiple independently driven adjacent sheet transport devices (e.g., a registration nip and an image transfer nip, an image transfer nip and an image fixing nip, or a registration nip, an image transfer nip and an image fixing nip), velocity discrepancies between the drive rollers of the devices will cause contention between their corresponding servomechanisms. As a result, a sheet velocity mismatch can occur between the leading edge of a print media sheet and the trailing edge of that same print media sheet at a given point along the sheet transport path. This mismatch can be caused not only by spiking drive roller velocity changes during transitions into and out of contention but also by servomechanisms essentially fighting for velocity control, during contention. Thus, consider a print media sheet being transported along a sheet transport path through a registration nip, a transfer nip and an image fixing nip in series. Since the print media sheet may be engaged by more than one of these nips at a time such that their servomechanisms move in and out of contention, there may be a sheet velocity mismatch between the leading and trailing edges of the print media sheet at the image transfer point. Such a mismatch can result in the same image disturbances (e.g., shearing, banding, etc.) due to the same errors (e.g., registration errors, image on image transfer errors, etc.) that the servomechanisms were designed to avoid.

One technique that can be used to avoid the above-described errors caused by contention between sheet transport device servomechanisms involves a pre-printing calibration process and is disclosed in U.S. Pat. No. 7,673,876 of DeGruchy, issued on Mar. 9, 2010, assigned to Xerox Corporation of Norwalk, Conn., USA and incorporated herein by reference. Another technique that can be used to avoid the above describe errors caused by such contention involves selectively operating each sheet transport device in alternating velocity and torque control modes as print media sheet is passed to each of the sheet transport devices in series and is disclosed in U.S. patent application Ser. No. 12/475,105, of Krucinski, filed on May 29, 2009, assigned to Xerox Corporation of Norwalk, Conn., USA and incorporated herein by reference. An alternative technique that can be used to avoid such errors is disclosed herein.

In view of the foregoing, disclosed herein are embodiments of printing system, printing method and computer program product using alternating velocity and torque control modes for one or more, but not all, independently driven sheet transport devices in a sheet transport path in order to avoid contention. Specifically, in a printing system having first, second and third independently driven sheet transport devices in series (e.g., a registration device, an image transfer device and an image fixing device), the second sheet transport device (e.g., the image transfer device) can always operate in a velocity control mode. However, the one or both of the other sheet transport devices (i.e., the immediately upstream and downstream devices) can alternate between operating in a velocity control mode and operating in a torque control mode. For example, the first sheet transport device (e.g., the registration device) can operate in the torque control mode, when a print media sheet is concurrently engaged by both the first and second sheet transport devices, and in a velocity control mode at all other times (e.g., when the print media sheet is not engaged by the second sheet transport device). Similarly, the third sheet transport device (e.g., the image fixing device) can operate in the torque control mode, when the print media sheet is concurrently engaged by both the second and third sheet transport devices and in the velocity control mode at all other times (e.g., when the print media sheet is not engaged by the second sheet transport device). Thus, the second sheet transport device (e.g., the image transfer device) can always be the dominant sheet transport device for purposes of sheet velocity control, ensuring that contention is avoided.

Figure 2:
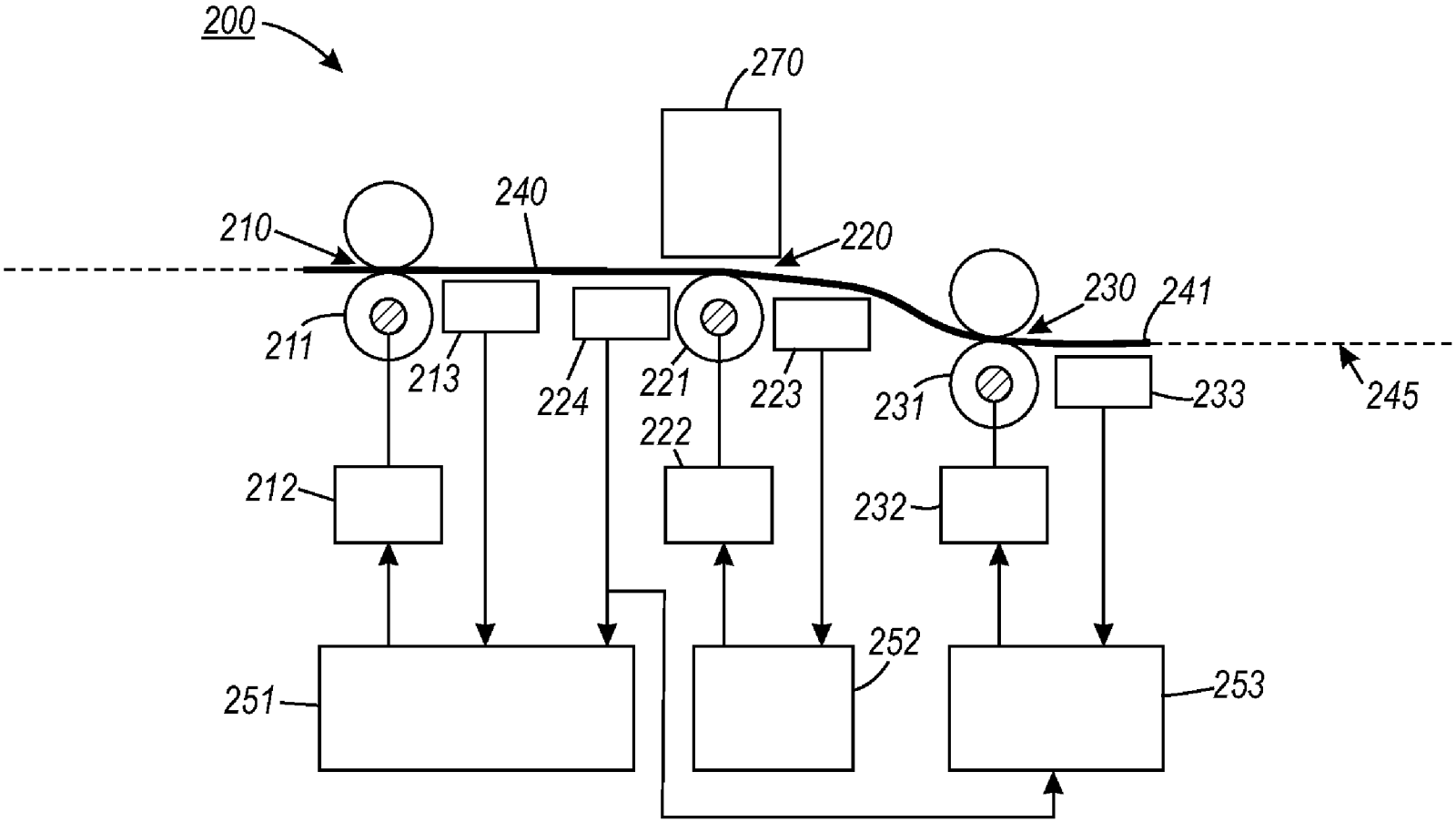
FIG. 2 is a schematic diagram illustrating another embodiment of a printing system.

More particularly, referring to FIGS. 1 and 2, disclosed herein are embodiments of a printing system 100, 200. The printing system 100, 200 can comprise at least three independently driven sheet transport devices (i.e., a first sheet transport device 110, 210, a second sheet transport device 120, 220 and a third sheet transport device 130, 230) in series along a sheet transport path 145, 245.

The first sheet transport device 110, 210 can comprise, for example, a print sheet registration device. This print sheet registration device can comprise, for example, a registration nip (as shown), a registration belt or any other suitable registration device that ensures (i.e., is adapted to ensure, is configured to ensure, etc.) proper positioning of a print media sheet 140, 240 prior to printing. The details of such print sheet registration devices are well-known in the art and, thus, are omitted from this specification to allow the reader to focus on the salient aspects of the invention.

The first sheet transport device 110, 210 can then transport (i.e., can be adapted to transport, can be configured to transport, etc.) the print media sheet 140, 240 along the sheet transport path 145, 245 to the second sheet transport device 120, 220. The second sheet transport device 120, 220 can comprise, for example, an image transfer device. This image transfer device can comprise, for example, an image transfer nip (as shown) or other suitable image transfer device that transfers (i.e., is adapted to transfer, is configured to transfer, etc.) a toner image from an electrostatographic printing engine 170, 270 onto a print media sheet 140, 240. Specifically, the image transfer device can transfer a toner image onto a print media sheet 140, 240, either directly from a photoreceptor drum of an electrostatographic printing engine 170, 270 or from an intermediate transfer member (e.g., an intermediate transfer belt (ITB)) incorporated into the electrostatographic printing engine 170, 270.

For example, an electrostatographic printing engine 170, 270 can comprise a photoreceptor drum, which is charged on its surface and exposed to light from an optical system, such as a laser and/or a light emitting diode, in order to form an electrostatic latent image thereon. The electrostatic latent image can be developed by bringing a developer mixture of toner particles into contact with the latent image on the photoreceptor drum (e.g., by use of a magnetic brush, powder cloud, or other known development process). After the latent image is developed (i.e., after the toner particles have been deposited onto the photoreceptor drum forming the toner image), the toner image can be transferred directly from the photoreceptor drum to the print media sheet 140, 240, by means of an image transfer device, which brings the print media sheet 140, 240 into contact with or close proximity to the photoreceptor drum and which employs, for example, pressure transfer techniques, electrostatic transfer techniques, or the like to accomplish the toner image transfer.

Alternatively, the electrostatic printing engine 170, 270 can comprise multiple discrete photoreceptor drums positioned in series adjacent to an intermediate transfer belt (ITB). Each photoreceptor drum can be associated with a different specific color. Those skilled in the art will recognize that these colors will typically comprise yellow (Y), magenta (M), cyan (C), and black (K); however, additional drums for additional colors may be used to enhanced image quality. Each photoreceptor drum can be separately charged on its surface and exposed to light from an optical system, such as a laser and/or a light emitting diode, in order to form an electrostatic latent image thereon. Each electrostatic latent image can be developed by bringing a developer mixture of the specific color toner particles associated with that drum into contact with the latent image (e.g., by use of a magnetic brush, powder cloud, or other known development process). These different color toner images on the respective photoreceptor drums can be transferred to a defined area of the ITB, for example, by pressure transfer techniques, electrostatic transfer techniques, or the like, in order to create a multi-colored toner image on the ITB. Once multi-color toner image is created on the ITB, it can subsequently be transferred from the ITB to the print media sheet 140, 240, by means of an image transfer device, which brings the print media sheet 140, 240 into contact with or close proximity to the ITB and which employs, for example, pressure transfer techniques, electrostatic transfer techniques, or the like to accomplish the toner image transfer. The details of such printing engines are well-known in the art and, thus, are omitted from this specification to allow the reader to focus on the salient aspects of the invention.

The second sheet transport device 120, 220 can then transport (i.e., can be adapted to transport, can be configured to transport, etc.) the print media sheet 140, 240 along the sheet transport path 145, 245 to a third sheet transport device 130, 230. This third sheet transport device 130, 230 can comprise, for example, an image fixing device. The image fixing device can comprise, for example, an image fusing nip, as shown, that applies (i.e., is adapted to apply, configured to apply, etc.) pressure and/or heat to the toner image and print media sheet 140, 240 in order to fix the toner image to the print media sheet 140, 240. Alternatively, the image fixing device can comprise any other suitable image fixing device. The details of such imaging fixing devices are well-known in the art and, thus, are omitted from this specification to allow the reader to focus on the salient aspects of the invention. The third sheet transport device 130, 230 can then transport the print media sheet 140, 240 along the sheet transport path 145, 245 to, for example, an output tray or to an additional sheet transport device for further processing (e.g., collating, stapling, binding, etc.).

Additionally, the printing system 100, 200 can further comprise either a single controller 150, as shown in FIG. 1, or multiple controllers 251-253, as shown in FIG. 2), which control operation of the independently driven sheet transport devices such that the second sheet transport device 120, 220 is always operating in a velocity control mode and one or both of the other sheet transport devices (i.e., the first sheet transport device 110, 210 and/or the third sheet transport device 130, 230) alternate between operating in a velocity control mode and operating in a torque control mode.

Specifically, a controller (e.g., either the global controller 150, as shown in FIG. 1, or a discrete controller 251, as shown in FIG. 2) can (i.e., can be adapted to, can be configured to, etc.) alternatingly operate the first sheet transport device 110, 210 in a velocity control mode and a torque control mode as the first sheet transport device 110, 210 receives the print media sheet 140, 240 (e.g., from a sheet feeding system), optionally processes the print media sheet 140, 240 and then transports the print media sheet 110, 210 to the second sheet transport device 120, 220. For example, the controller 150 or 251 can use the velocity control mode when the print media sheet 140, 240, 340, 440 has just been received by the first sheet transport device 110, 210 and is not yet engaged by the second sheet transport device 120, 220. However, the controller 150 or 251 can use the torque control mode (i.e., can switch the control mode) when the print media sheet 140, 240 is still engaged by the first sheet transport device 110, 210 and the leading edge 141, 241 has reached the second sheet transport device 120, 220 (i.e., when the print media sheet 140, 240 is concurrently engaged by both the first and second sheet transport devices).

Either the same or a different controller (e.g., either the global controller 150, as shown in FIG. 1, or a discrete controller 252, as shown in FIG. 2) can (i.e., can be adapted to, can be configured to, etc.) operate the second sheet transport device 120, 220 solely in the velocity control mode as the second sheet transport device 120, 220 receives the print media sheet 140, 240 from the first sheet transport device 110, 210, optionally processes the print media sheet 140, 240 and then transports the print media sheet 140, 240 to the third sheet transport device 130, 230.

Either the same or a different controller (e.g., either the global controller 150, as shown in FIG. 1, or a discrete controller 253, as shown in FIG. 2) can (i.e., can be adapted to, can be configured to, etc.) alternating operate the third sheet transport device 130, 230 in the torque control mode and the velocity control mode as the third sheet transport device 130, 230 receives the print media sheet 140, 240 from the second sheet transport device 120, 220, optionally processes the print media sheet 140, 240 and, then, transports the print media sheet 140, 240 either to an output tray or to an additional sheet transport device for further processing. For example, the controller 150 or 253 can use the torque control mode when the print media sheet 140, 240 is received by the third sheet transport device and still engaged by the second sheet transport device 120, 220 (i.e., when the print media sheet 140, 240 is concurrently engaged by both the second sheet transport device 120, 220 and third sheet transport device 130, 230). However, the controller 150 or 253 can use the velocity control mode (i.e., can switch the control mode) when the print media sheet 140, 240 is no longer engaged by the second sheet transport device.

Thus, in the event that a print media sheet 140, 240 is concurrently engaged by each of three sheet transport devices, the controller(s) can operate the first sheet transport device 110, 210 and/or the third sheet transport device 130, 230 in the torque control mode and the second sheet transport device 120, 220 in the velocity control mode.

If a global controller 150 is used, as shown in FIG. 1, it should comprise a hybrid controller so as to effectively control operation of the different sheet transport devices (i.e., the first sheet transport device 110, 210, the second sheet transport device 120, 220 and the third sheet transport device 130, 230). Those skilled in the art will recognize that a hybrid controller is a controller that can operate (i.e., that is adapted to operate, configured to operate, programmed to operate, etc.) a sheet transport device in multiple different modes (e.g., a velocity control mode and a torque control mode). Such a hybrid controller should further operate (i.e., be adapted to operate, configured to operate, programmed to operate, etc.) a sheet transport device in transition control modes between the velocity control and torque control modes and vice versa. Such transition control modes will ensure gradual transitions between the different modes and, thereby minimize any errors and/or disturbance that would otherwise result. If multiple controllers (e.g., 251-253) are used to control operation of the different sheet transport devices, as shown in FIG. 2, then either the same hybrid controller (not shown) or discrete hybrid controllers 251 and 253 can control operation of the first and third sheet transport devices 210 and 230, respectively, whereas a single-mode controller 252 can control operation of the second sheet transport device 220. Those skilled in the art will recognize that a single-mode controller is a controller that can operate (i.e., that is adapted to operate, configured to operate, programmed to operate, etc.) a sheet transport device in a single mode (e.g., a velocity control mode).

In either case the controller(s) can comprise servomechanisms, which independently control the sheet transport devices and, more particularly, the device servo motors (e.g., drive motors), which cause the drive rollers of the sheet transport devices to rotate. In the velocity control mode this control is based on feedback from a velocity sensor and in the torque control mode this control is optionally based on feedback from a sheet tension sensor.

Specifically, in addition to the above described components of the printing system 100, 200, each sheet transport device can comprise a corresponding drive roller rotated by a corresponding servo motor (i.e., drive motor). For example, the first sheet transport device 110, 210 comprises a first drive roller 121, 221 rotated by first servo motor, the second sheet transport device 120, 220 comprises a second drive roller 122, 222 rotated by a second servo motor and the third sheet transport device 130, 230 comprises a third drive roller 123, 223 rotated by a third servo motor.

To support the operation of the different sheet transport devices in the velocity control mode, the printing system 100, 200 can further comprise a plurality of velocity sensors, each associated with one of the different sheet transport devices. For example, a first velocity sensor 113, 213 can be associated with the first sheet transport device 110, 210 and can measure the sheet velocity (i.e., linear velocity) of the print media sheet 140, 240 as the print media sheet 140, 240 is transported by the first sheet transport device 110, 210. A second velocity sensor 123, 223 can be associated with the second sheet transport device 120, 220 and can measure the sheet velocity (i.e., linear velocity) of the print media sheet 140, 240 as the print media sheet 140, 240 is transported by the second sheet transport device 120, 220. A third velocity sensor 133, 233 can be associated with the third sheet transport device 130, 230 and can measure the sheet velocity (i.e., linear velocity) of the print media sheet 140, 240 as the print media sheet 140, 240 is transported by the third sheet transport device 130, 230. The details of such velocity sensors are well-known in the art and, thus, are omitted from this specification to allow the reader to focus on the salient aspects of the invention.

During the velocity control mode for a respective one of the first, second or third sheet transport devices (e.g., 110, 210; 120, 220; or 130, 230), the measured sheet velocity for that device can be communicated to the controller (e.g., 150, 251; 150, 252; or 150, 253, as applicable). Then, based on this measured sheet velocity, the controller can cause (i.e., can be adapted to cause, configured to cause, programmed to cause, etc.) the angular velocity of the drive roller (e.g., 112, 212; 122, 222; or 132, 232, as applicable) for that device to be selectively adjusted (i.e., increased or decreased), for example, by causing the power supply to the device servo motor to be selectively increased or decreased, in order to achieve either a predetermined constant sheet velocity or a predetermined varying sheet velocity profile.

Additionally, to support operation of the first sheet transport device 110, 210 and the third sheet transport device 130, 230 in the torque control mode, the printing system 100, 200 can also further comprise a tension sensor 124, 224. The tension sensor 124, 224 can be used to determine sheet tension at the second sheet transport device 120, 220. Specifically, the tension sensor 124, 224 can measure the level of sheet tension directly or, alternatively, can determine the level of sheet tension indirectly (e.g., by measuring sheet buckling). The details of such tension sensors are well-known in the art and, thus, are omitted from this specification to allow the reader to focus on the salient aspects of the invention.

During the torque control mode for either the first sheet transport device 110, 210 or the third sheet transport device 130, 230, this determined level of sheet tension at the second sheet transport device 120, 220 can be communicated to the controller(s) (e.g., 150, 251 or 150, 253, as applicable). Based on the determined level of sheet tension, the controller(s) (e.g., 150, 251 or 150, 253, as applicable) can cause (i.e., can be adapted to cause, can be configured to cause, can be programmed to cause, etc.) either a varying level of torque to be applied to the drive roller of a respective first or third sheet transport device or a varying level of power to be supplied to the drive motor of the respective first or third sheet transport device in order to selectively adjust (i.e., increase or decrease) the sheet tension at the second sheet transport device 120, 220 and, thereby to continuously maintain a desired level of sheet tension at the second sheet transport device 120, 220.

It should be noted that, alternatively, during the torque control mode, the controller(s) (e.g., 150, 251 or 150, 253, as applicable) can cause (i.e., can be adapted to cause, can be configured to cause, can be programmed to cause, etc.) any one of the following to occur: a constant set point level of torque to be applied to a drive roller of a respective first sheet transport device or third sheet transport device 130, 230 based on a previously measured and recorded level of torque applied to that drive roller during a velocity control mode; or a constant set point level of power to be supplied to a drive motor of a respective first sheet transport device 110, 210 or third sheet transport device 130, 230 based on a previously measured and recorded level of power supplied to that drive motor during a velocity control mode. Alternatively, in the torque control mode, the controller(s) (e.g., 150, 251 or 150, 253, as applicable) can cause any one of the following to occur: a level of torque to be applied to a drive roller of a respective first sheet transport device 110, 210 or third sheet transport device 130, 230 based on a measured (e.g., in real-time or previously recorded) level of torque applied to the drive roller of the second sheet transport device 120, 220; or a level of power to be supplied to a drive motor of a respective first 110, 210 or third sheet transport device 130, 230 based on a measured (e.g., in real-time or previously recorded) level of power supplied to the drive motor of the second sheet transport device 120, 220. Alternatively, in the torque control mode, the controller(s) (e.g., 150, 251 or 150, 253, as applicable) can cause any other level of torque to be applied to the drive roller(s) of the first and/or third sheet transport devices (or any other level of power to be supplied to drive motor(s) of the first and/or third sheet transport devices), which will ensure that the second sheet transport device 120, 220 remains the dominant sheet transport device for purposes of velocity control. Ensuring that the second sheet transport device is the dominant sheet transport device for purposes of velocity control is particularly important when the second sheet transport device's function in regards to the printing operation depends on accurate (i.e., precise) velocity control (e.g., when the second sheet transport device is an image transfer device and precise velocity control is required for proper image placement on the print media sheet). In any case, the level of torque that is applied (or the level of power that is supplied) based on a real-time or previously recorded measured level can be either equal to that measured level or equal to the measured level plus or minus a predetermined delta. Devices for measuring and recording (i.e., monitoring) levels of power and/or torque, as described above, are well-known in the art. Thus, the details of such devices are omitted from this specification in order to allow the reader to focus on the salient aspects of the invention.

It should further be noted that, for illustration purposes, the first, second and third sheet transport devices (i.e., the multiple independently driven sheet transport devices in series) are described herein as comprising a print sheet registration device, an image transfer device and an image fixing device, respectively, in an electrostatographic (i.e., toner-based) printing system. However, it should be understood that the first, second and third sheet transport devices can, alternatively, comprise any other multiple independently driven sheet transport devices in series (e.g., electrostatic sheet transport belts, nip roller apparatuses, etc.) in any other type of printing system (e.g., a liquid ink jet printing system, a solid ink printing system, etc.) that would benefit from such a printing system, which ensures that only one of multiple sheet transport devices in a series is the dominant sheet transport device for purposes of sheet velocity control and which, thereby avoids errors caused by contention. Ensuring that a sheet transport device is the dominant sheet transport device for purposes of velocity control is particularly important when the sheet transport device's function in regards to the printing operation depends on accurate (i.e., precise) velocity control. Like the image transfer device, sheet transport devices having other printing operation functions (e.g., sheet cleaning, sheet cutting, sheet folding, etc.) could similarly benefit from being the dominant sheet transport device for purposes of velocity control.

Figure 3:
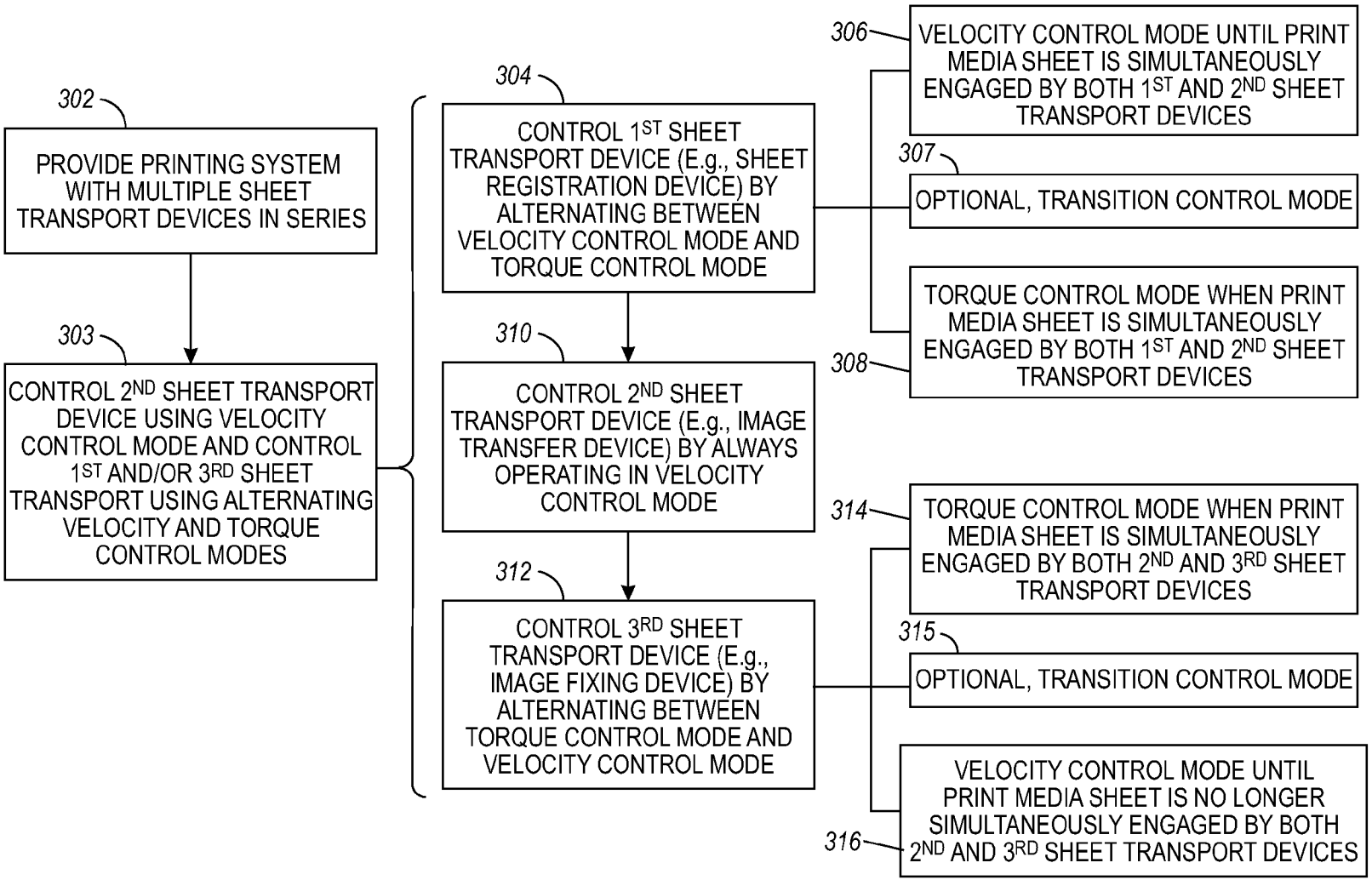
FIG. 3 is a flow diagram illustrating an embodiment of a printing method.

Referring to the flow diagram of FIG. 3 in combination with printing system diagrams of FIGS. 1 and 2, also disclosed herein are embodiments of a printing method for use in conjunction with the above-described printing system 100, 200 (302). Generally, the method embodiments can comprise independently controlling the multiple sheet transport devices that transport a print media sheet along the sheet transport path. The process of independently controlling these sheet transport devices can comprise controlling the second sheet transport device 120, 220 solely using a velocity control mode and further controlling the first sheet transport device 110, 210 and/or the third sheet transport device 130, 230 alternatingly using a velocity control mode and a torque control mode (303).

Specifically, the first sheet transport device 110, 210 (e.g., a sheet registration device) can be controlled as the first sheet transport device 110, 210 receives a print media sheet 140, 240, optionally process the print media sheet 140, 240 (e.g., registers the print media sheet) and then transports that print media sheet 140, 240 to a second sheet transport device 120, 220 (e.g., an image transfer device) (304). The process of controlling of the first sheet transport device 110, 210 can comprise alternatingly using a velocity control mode and a torque control mode. For example, the velocity control mode can be used when the print media sheet 140, 240 has just been received by the first sheet transport device 110, 210 and is not yet engaged by the second sheet transport device 120, 220 (306). However, the torque control mode can be used (i.e., the control mode can be switched) when the print media sheet 140, 240 is still engaged by the first sheet transport device 110, 210 and the leading edge 141, 241 has reached the second sheet transport device 120, 220 (i.e., when the print media sheet is concurrently engaged by both the first and second sheet transport devices) (308).

The second sheet transport device 120, 220 can be controlled as the second sheet transport device 120, 220 receives the print media sheet 140, 240 from the first sheet transport device 110, 210, optionally processes the print media sheet 140, 240 (e.g., transfers an image onto the print media sheet), and then transports the print media sheet 140, 240 to the third sheet transport device 130, 230 (310). The process of controlling the second sheet transport device 120, 220 can comprise solely using a velocity control mode such that the second sheet transport device 120, 220 is always the dominant sheet transport device for purposes of sheet velocity control. Ensuring that the second sheet transport device is the dominant sheet transport device for purposes of velocity control is particularly important when the second sheet transport device's function in regards to the printing operation depends on accurate (i.e., precise) velocity control (e.g., when the second sheet transport device is an image transfer device and precise velocity control is required for proper image placement on the print media sheet).

The third sheet transport device 130, 230 can be controlled as the third sheet transport device 130, 230 receives the print media sheet 140, 240 from the second sheet transport device 120, 220, optionally processes the print media sheet (e.g., fuses the toner image onto the print media sheet), and then transports the print media sheet 140, 240 to either an output tray or to an additional sheet transport device for further processing (312). The process of controlling of the third sheet transport device 130, 230, like the process of controlling the first sheet transport device 110, 210, can comprise alternatingly using the torque control mode and the velocity control mode. For example, the torque control mode can be used when the print media sheet 140, 240 is received by the third sheet transport device 130, 230 and still engaged by the second sheet transport device 120, 220 (i.e., when the print media sheet is concurrently engaged by both the second 120, 220 and third 130, 230 sheet transport devices) (314). However, the velocity control mode can be used (i.e., the control mode can be switched) when the print media sheet 140, 240 is no longer engaged by the second sheet transport device 120, 220 (i.e., at all other times) (316).

Thus, in the event that a print media sheet 140, 240 is concurrently engaged by each of three sheet transport devices, the first sheet transport device 110, 210 and the third sheet transport device 130, 230 can be operated using a torque control mode and the second sheet transport device 120, 220 can be operated using the velocity control mode, ensuring that the second sheet transport device 120, 220 is the dominant device for velocity control purposes. Ensuring that the second sheet transport device is the dominant sheet transport device for purposes of velocity control is particularly important when the second sheet transport device's function in regards to the printing operation depends on accurate (i.e., precise) velocity control (e.g., when the second sheet transport device is an image transfer device and precise velocity control is required for proper image placement on the print media sheet).

Figure 4:
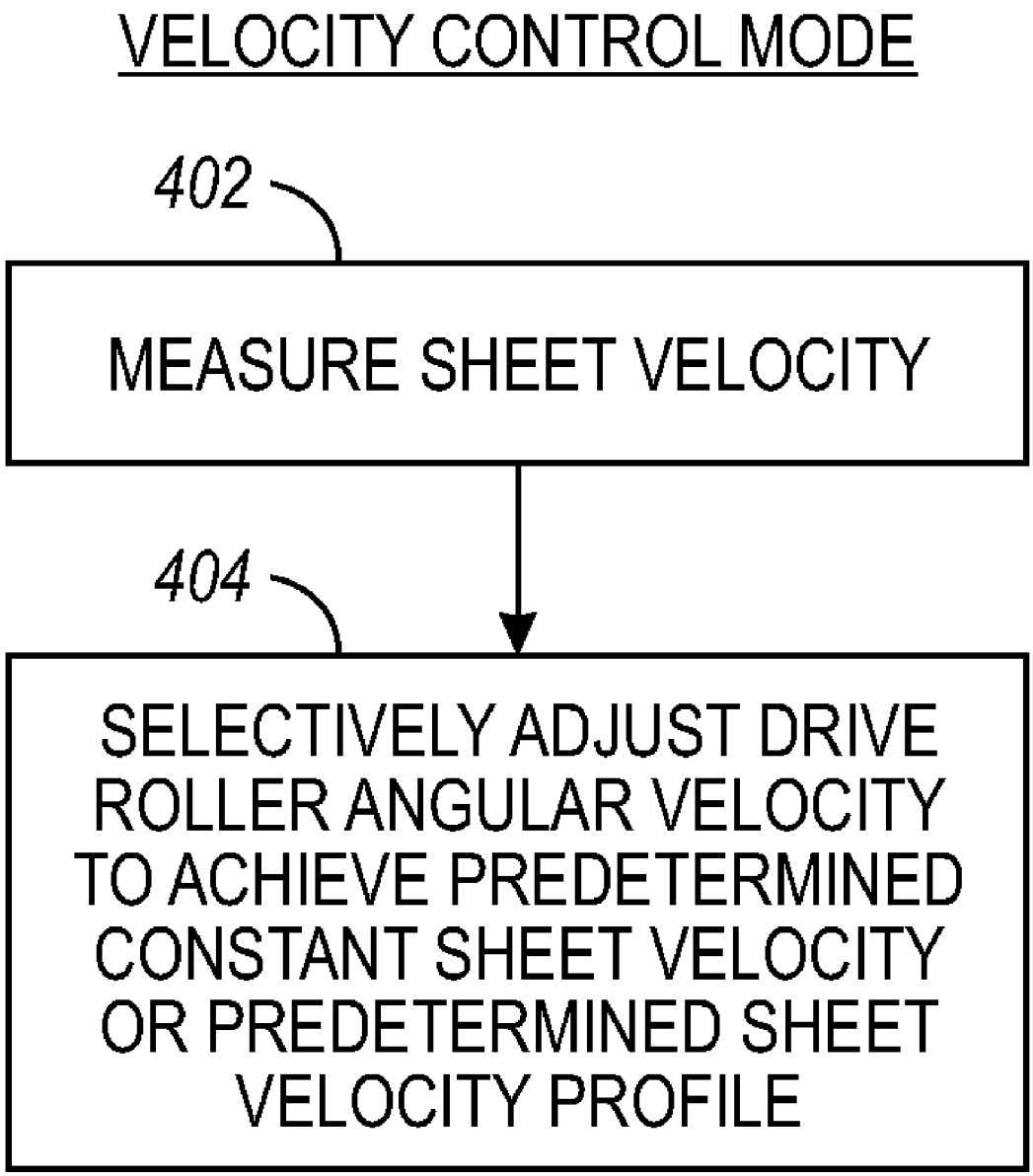
FIG. 4 is a flow diagram illustrating a velocity control mode as used in conjunction with the printing method of FIG. 3.

Referring to FIG. 4, the process of controlling a particular sheet transport device (e.g., 110, 210; 120, 220; or 130, 230) by using a velocity control mode can comprise first measuring the sheet velocity (i.e., the linear velocity) of the print media sheet 140, 240 as it is transported by that sheet transport device (402). For example, a first velocity sensor 113, 213 can be associated with the first sheet transport device 110, 210 and can measure the sheet velocity (i.e., linear velocity) of the print media sheet 140, 240 as the print media sheet 140, 240 is transported by the first sheet transport device 110, 210. A second velocity sensor 123, 223 can be associated with the second sheet transport device 120, 220 and can measure the sheet velocity (i.e., linear velocity) of the print media sheet 140, 240 as the print media sheet 140, 240 is transported by the second sheet transport device 120, 220. A third velocity sensor 133, 233 can be associated with the third sheet transport device 130, 230 and can measure the sheet velocity (i.e., linear velocity) of the print media sheet 140, 240 as the print media sheet 140, 240 is transported by the third sheet transport device 130, 230. Then, based on the measured sheet velocity, the angular velocity of a drive roller (e.g., 112, 212; 122, 222; or 132, 232) of that particular sheet transport device can be selectively adjusted (i.e., increased or decreased), for example, by causing the power supply to the device servo motor to be selectively increased or decreased, in order to achieve either a predetermined constant sheet velocity or a predetermined varying sheet velocity profile (404).

Figure 5:
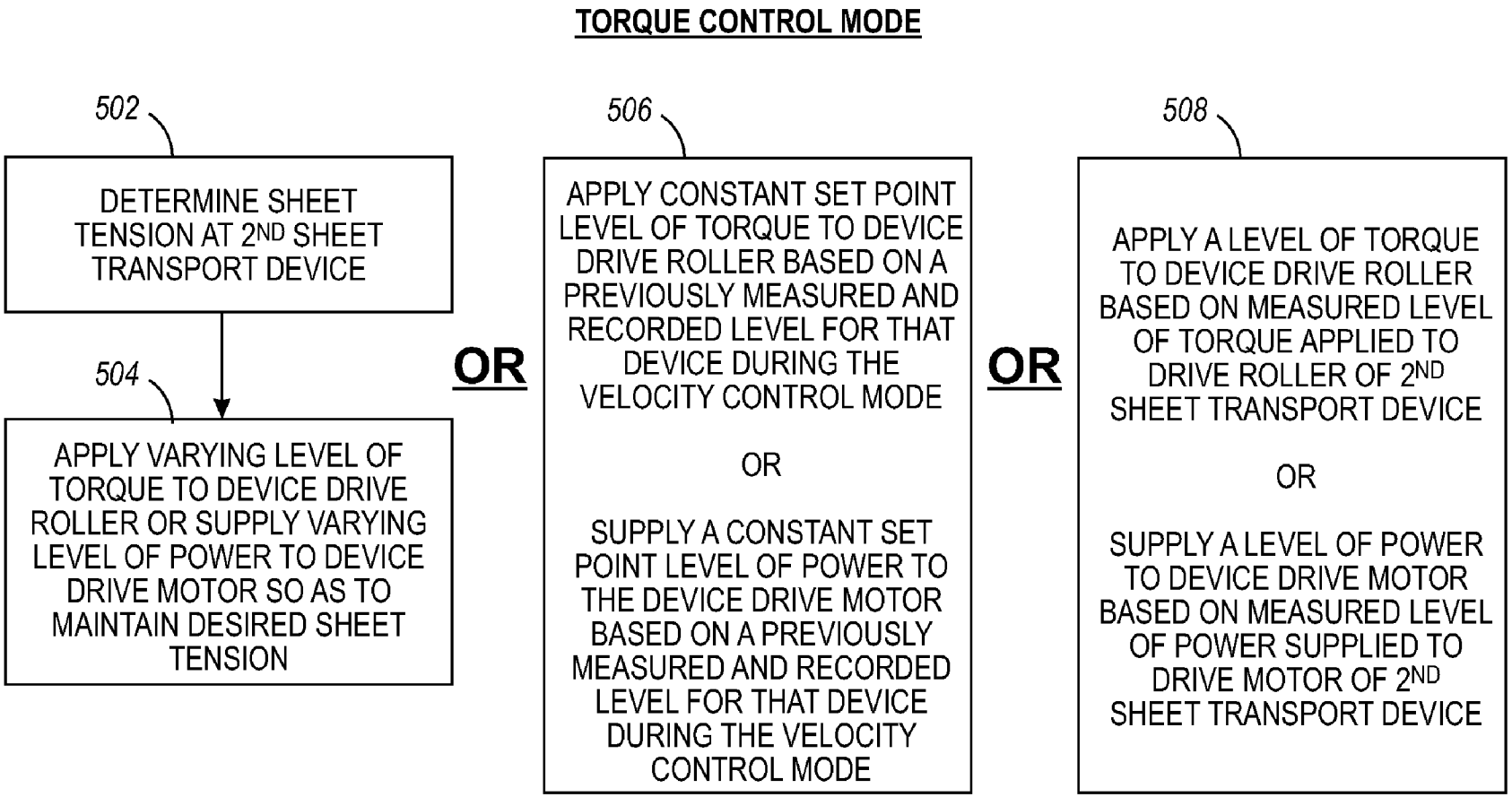
FIG. 5 is a flow diagram illustrating a torque control mode as used in conjunction with the printing method of FIG. 3.

Referring to FIG. 5, the process of controlling a particular sheet transport device (e.g., the first sheet transport device 110, 210 or the third sheet transport device 130, 230) using the torque control mode can comprise any one of various techniques that will ensure that the second sheet transport device 120, 220 remains the dominant sheet transport device for purposes of velocity control. Ensuring that the second sheet transport device is the dominant sheet transport device for purposes of velocity control is particularly important when the second sheet transport device's function in regards to the printing operation depends on accurate (i.e., precise) velocity control (e.g., when the second sheet transport device is an image transfer device and precise velocity control is required for proper image placement on the print media sheet).

For example, in one technique, sheet tension at the second sheet transport device 120, 220 can be determined using a tension sensor 124, 224 (502). Specifically, the tension sensor 124, 224 can measure the level of sheet tension directly or, alternatively, can determine the level of sheet tension indirectly (e.g., by measuring sheet buckling). Then, based on the determined level of sheet tension, a varying level of torque can be applied to the drive roller of the respective first or third sheet transport device or a varying level of power can be supplied to the drive motor of the respective first or third sheet transport device in order to selectively adjust (i.e., increase or decrease) the sheet tension at the second sheet transport device 120, 220 and, thereby to continuously maintain a desired level of sheet tension at the second sheet transport device 120, 220 (504).

Alternatively, for either the first sheet transport device 110, 210 or the third sheet transport device 130, 230, using the torque control mode can comprise any of the following (506): applying a constant set point level of torque to a drive roller of a respective first sheet transport device 110, 210 or third sheet transport device 130, 230 based on a previously measured and recorded level of torque applied to that drive roller during a velocity control mode; or supplying a constant set point level of power to a drive motor of a respective first sheet transport device 110, 210 or third sheet transport device 130, 230 based on a previously measured and recorded level of power supplied to that drive motor during a velocity control mode. Alternatively, using the torque control mode can comprise any of the following (508): applying a level of torque to a drive roller of a respective first sheet transport device 110, 210 or third sheet transport device 130, 230 based on a measured (e.g., in real-time or previously recorded) level of torque applied to the drive roller of the second sheet transport device 120, 220; or supplying a level of power to a drive motor of a respective first sheet transport device 110, 210 or third sheet transport device 130, 230 based on a measured (e.g., in real-time or previously recorded) level of power supplied to the drive motor of the second sheet transport device 120, 220. Alternatively, using the torque control mode can comprise applying any other level of torque to a drive roller of a respective first or third sheet transport device or supplying any other level of power to the drive motor of the respective first or third sheet transport device, which will ensure that the second sheet transport device 120, 220 remains the dominant sheet transport device for purposes of velocity control. Ensuring that the second sheet transport device is the dominant sheet transport device for purposes of velocity control is particularly important when the second sheet transport device's function in regards to the printing operation depends on accurate (i.e., precise) velocity control (e.g., when the second sheet transport device is an image transfer device and precise velocity control is required for proper image placement on the print media sheet). In any case, the level of torque that is applied (or the level of power that is supplied) based on a real-time or previously recorded measured level can be either equal to that measured level or equal to the measured level plus or minus a predetermined delta.

Referring again to FIG. 3, optionally, a sheet transport device will be controlled such that it enters transition control modes between the velocity control and torque control modes and vice versa (307 and 315). Such transition control modes will ensure gradual transitions between the different modes and, thereby minimize any errors and/or disturbance that would otherwise result.

Also disclosed herein are embodiments of a computer program product. This computer program product can comprise a computer usable medium having computer useable program code embodied therewith. The computer usable program code can be configured specifically to perform the above-described printing method. This computer program product can comprise a tangible computer-usable (i.e., computer-readable) medium on which a computer-useable (i.e., computer-readable) program code (i.e., a control program, a set of executable instructions, etc.) is recorded or embodied. Tangible computer-usable media can, for example, a memory device on which the program is recorded or, alternatively, can comprise a transmittable carrier wave in which the program is embodied as a data signal. Exemplary forms of tangible computer-usable media include, but are not limited to, floppy disks, flexible disks, hard disks, magnetic tape, any other magnetic storage medium, CD-ROM, DVD, any other optical medium, a RAM, a PROM, an EPROM, a FLASH-EPROM, any other memory chip or cartridge, transmission media (e.g., acoustic or light waves generated during radio wave or infrared data communications, respectively) or any other medium from which a computer can read and use program code. In this case, the computer-usable program code can be specifically configured to perform the above-described printing method. That is, the computer-usable program code can be read by and executed by a computer in order to perform the above-described method.

It should be noted that, for illustration purposes, in the embodiments described above, the first, second and third sheet transport devices (i.e., the multiple independently driven sheet transport devices in series) are described a print sheet registration device, an image transfer device and an image fixing device, respectively, in an electrostatographic (i.e., toner-based) printing system. However, it should be understood that the first, second and third sheet transport devices can, alternatively, comprise any other independently driven sheet transport devices in series (e.g., electrostatic sheet transport belts, nip roller apparatuses, etc.) in any other type of printing system (e.g., a liquid ink jet printing system, a solid ink printing system, etc.) that would benefit from the invention disclosed herein which ensures that only one of multiple sheet transport devices in a series is the dominant sheet transport device for purposes of sheet velocity control and which, thereby avoids errors caused by contention. Ensuring that a sheet transport device is the dominant sheet transport device for purposes of velocity control is particularly important when the sheet transport device's function in regards to the printing operation depends on accurate (i.e., precise) velocity control. Like the image transfer device, sheet transport devices having other printing operation functions (e.g., sheet cleaning, sheet cutting, sheet folding, etc.) could similarly benefit from being the dominant sheet transport device for purposes of velocity control.

It should be understood that the terms "image reproduction machine", "printing system", "printing device", "image output terminal", etc. are used interchangeably herein and encompass any apparatus, which performs a print outputting function for any purpose, (e.g., a printer, copier, bookmaking machine, facsimile machine, multi-function machine, etc.). The details of these various apparatuses are well-known by those ordinarily skilled in the art and are discussed in, for example, the following patent documents assigned to Xerox Corporation of Norwalk, Conn., USA and incorporated herein by reference: U.S. Pat. No. 6,032,004 of Mirabella et al, issued on Feb. 29, 2000; U.S. Patent Application Publication No. 2003/0108369 of Kuo, et al., published on Jun. 12, 2003; U.S. patent application Ser. No. 12/361,751 of Atwood et al., filed on Jan. 29, 2009; and U.S. Pat. No. 7,305,200 of Hoffman et al., issued on Dec. 4, 2007. The embodiments herein can encompass embodiments that print in color, monochrome, or handle color or monochrome image data. All foregoing embodiments are specifically applicable to electrostatographic and/or xerographic machines and/or processes.

Additionally, it should further be understood that the term "print media sheet" as used herein encompasses any cut sheet of print media substrate suitable for receiving images, such as, a sheet of paper, plastic, vinyl, etc. The term "sheet transport path" as used herein encompasses all paths through which print media sheets are transported. The term "sheet transport device" as used herein encompasses any sheet transport device (e.g., a nip apparatus, a sheet transport belt or any other sheet transport device) that is configured (e.g., with a drive roller) to cause print media sheets in a sheet transport path to be transported in a given direction, including but not limited to, sheet transport devices with integrated printing system functions (e.g., registrations devices, image transfer devices, image fixing devices, such as fusing devices, etc.). Finally, the term "controller" (e.g., controller 150 of FIG. 1, controllers 251-253 of FIG. 2, etc.) as used herein can comprise a programmable, self-contained, dedicated mini-computer having a central processor unit (CPU), electronic storage, and, optionally, a display or user interface (UI).

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted here from to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Therefore, disclosed above are embodiments of printing system and method using alternating voltage and torque control modes for one or more select independently driven sheet transport devices in a sheet transport path in order to avoid contention. Specifically, in a printing system having first, second and third independently driven sheet transport devices in series (e.g., a registration device, an image transfer device and an image fixing device), the second sheet transport device (e.g., the image transfer device) can always operate in a velocity control mode. However, one or both of the other sheet transport devices (i.e., the immediately upstream and downstream devices) can alternate between operating in a velocity control mode and operating in a torque control mode. For example, the first sheet transport device (e.g., the registration device) can operate in the torque control mode, when a print media sheet is concurrently engaged by both the first and second sheet transport devices, and in a velocity control mode at all other times (e.g., when the print media sheet is not engaged by the second sheet transport device). Additionally or alternatively, the third sheet transport device (e.g., the image fixing device) can operate in the torque control mode, when the print media sheet is concurrently engaged by both the second and third sheet transport devices and in the velocity control mode at all other times (e.g., when the print media sheet is not engaged by the second sheet transport device). Thus, the second sheet transport device (e.g., the image transfer device) can always be the dominant sheet transport device for purposes of sheet velocity control, ensuring that contention is avoided and, thereby avoiding image disturbances, such as shearing and banding.

What is claimed is:

1. A printing method comprising:

independently controlling multiple sheet transport devices transporting a print media sheet along a sheet transport path, said sheet transport devices comprising a first sheet transport device, a second sheet transport device and a third sheet transport device in series and said independently controlling comprising, during a printing operation, controlling said second sheet transport device solely using a velocity control mode such that said velocity control mode is used as said second sheet transport device receives said print media sheet from said first sheet transport device, when both said second sheet transport device and said first sheet transport device concurrently engage said print media sheet, and further such that said velocity control mode is used as said second sheet transport device transports said print media sheet to said third sheet transport device, when both said second sheet transport device and said third sheet transport device concurrently engage said print media sheet; and controlling any one of said first sheet transport device and said third sheet transport device alternatingly using a velocity control mode and a torque control mode.

2. The method of claim 1, said using of said velocity control mode comprising selectively adjusting drive roller angular velocity in order to achieve any one of a predetermined constant sheet velocity and a predetermined sheet velocity profile.

3. The method claim 1, said using of said torque control mode comprising any one of the following:

applying a constant set point level of torque to said one of said first sheet transport device and said third sheet transport device based on a previously measured and recorded level of torque applied to said one of said first sheet transport device and said third sheet transport device during said velocity control mode; and supplying a constant set point level of power to said one of said first sheet transport device and said third sheet transport device based on a previously measured and recorded level of power supplied to said one of said first sheet transport device and said third sheet transport device during said velocity control mode.

4. The method of claim 1, said using of said torque control mode comprising any one of the following:

applying a level of torque to said one of said first sheet transport device and said third sheet transport device based on a measured level of torque applied to said second sheet transport device; and supplying a level of power to said one of said first sheet transport device and said third sheet transport device based on a measured level of power supplied to said second sheet transport device.

5. The method of claim 1, said using of said torque control mode comprising applying any one of a varying level of torque and a varying level of power to said one of said first sheet transport device and said third sheet transport device so that a desired level of sheet tension is maintained at said second sheet transport device.

6. The method of claim 1, said controlling of said one of said first sheet transport device and said third sheet transport device comprising using a transition control mode when transitioning from said velocity control mode to said torque control mode and further when transitioning from said torque control mode to said velocity control mode.

7. The method of claim 1, said first sheet transport device comprising a registration device, said second sheet transport device comprising an image transfer device and said third sheet transport device comprising an image fixing device.

8. A method comprising:

independently controlling multiple sheet transport devices transporting a print media sheet along a sheet transport path, said sheet transport devices comprising a first sheet transport device, a second sheet transport device and a third sheet transport device in series and said independently controlling comprising:

controlling said first sheet transport device as said first sheet transport device receives a print media sheet and transports said print media sheet to said second sheet transport device, said controlling of said first sheet transport device comprising alternatingly using a velocity control mode and a torque control mode;

controlling said second sheet transport device as said second sheet transport device receives said print media sheet from said first sheet transport device and transports said print media sheet to said third sheet transport device, said controlling of said second sheet transport device comprising solely using said velocity control mode; and controlling said third sheet transport device as said third sheet transport device receives said print media sheet from said second sheet transport device and further transports said print media sheet, said controlling of said third sheet transport device comprising alternatingly using said torque control mode and said velocity control mode.

9. The method of claim 8, said controlling of said first sheet transport device further comprising: using said velocity control mode, when said print media sheet is not concurrently engaged by said second sheet transport device; and using said torque control mode, when said print media sheet is concurrently engaged by both said first sheet transport device and said second sheet transport device, said controlling of said second sheet transport device further comprising: using said velocity control mode, when both said second sheet transport device and said first sheet transport device concurrently engage said print media sheet and when both said second sheet transport device and said third sheet transport device concurrently engage said print media sheet, and said controlling of said third sheet transport device further comprising: using said torque control mode, when said print media sheet is concurrently engaged by both said second sheet transport device and said third sheet transport device, and using said velocity control mode, when said print media sheet is not concurrently engaged by said second sheet transport device.

10. The method of claim 8, said using of said velocity control mode comprising selectively adjusting drive roller angular velocity in order to achieve any one of a predetermined constant sheet velocity and a predetermined sheet velocity profile.

11. The method claim 8, said using of said torque control mode comprising any one of the following:

applying a constant set point level of torque to a corresponding one said first sheet transport device and said third sheet transport device based on a previously measured and recorded level of torque applied to said corresponding one said first sheet transport device and said third sheet transport device during said velocity control mode;

supplying a constant set point level of power to a corresponding one said first sheet transport device and said third sheet transport device based on a previously measured and recorded level of power supplied to said corresponding one of said first sheet transport device and said third sheet transport device during said velocity control mode;

applying a level of torque to a corresponding one of said first sheet transport device and said third sheet transport device based on a measured level of torque applied to said second sheet transport device;

supplying a level of power to a corresponding one of said first sheet transport device and said third sheet transport device based on a measured level of power supplied to said second sheet transport device.

12. The method of claim 8, said using of said torque control mode comprising any one of applying a varying level of torque to a corresponding one of said first sheet transport device and said third sheet transport device and supplying a varying level of power to said corresponding one of said first sheet transport device and said third sheet transport device so that a desired level of sheet tension is maintained at said second sheet transport device.

13. The method of claim 8, said controlling of said first sheet transport device and said controlling of said third sheet transport device each comprising using a transition control mode when transitioning from said velocity control mode to said torque control mode and further when transitioning from said torque control mode to said velocity control mode.

14. The method of claim 8, said first sheet transport device comprising a registration device, said second sheet transport device comprising an image transfer device and said third sheet transport device comprising an image fixing device.

15. A printer comprising:

multiple sheet transport devices transporting a print media sheet along a sheet transport path, said sheet transport devices comprising a first sheet transport device, a second sheet transport device and a third sheet transport device in series; and at least one controller controlling said multiple sheet transport devices as follows:

controlling said second sheet transport device solely using a velocity control mode such that said velocity control mode is used as said second sheet transport device receives said print media sheet from said first sheet transport device, when both said second sheet transport device and said first sheet transport device concurrently engage said print media sheet, and further such that said velocity control mode is used as said second sheet transport device transports said print media sheet to said third sheet transport device, when both said second sheet transport device and said third sheet transport device concurrently engage said print media sheet; and controlling any one of said first sheet transport device and said third sheet transport device alternatingly using a velocity control mode and a torque control mode.

16. The printer of claim 15, said at least one controller causing, in said velocity control mode, drive roller angular velocity to be selectively adjusted in order to achieve any one of a predetermined constant sheet velocity and a predetermined sheet velocity profile.

17. The printer of claim 15, said at least one controller causing, in said torque control mode, any one of the following:

a constant set point level of torque to be applied to said one of said first sheet transport device and said third sheet transport device based on a previously measured and recorded level of torque applied to said one of said first sheet transport device and said third sheet transport device during said velocity control mode; and a constant set point level of power to be supplied to said one of said first sheet transport device and said third sheet transport device based on a previously measured and recorded level of power supplied to said one of said first sheet transport device and said third sheet transport device during said velocity control mode.

18. The printer of claim 15, said at least one controller causing, in said torque control mode, any one of the following:

a level of torque to be applied to said one of said first sheet transport device and said third sheet transport device based on a measured level of torque applied to said second sheet transport device; and a level of power to be supplied to said one of said first sheet transport device and said third sheet transport device based on a measured level of power supplied to said second sheet transport device.

19. The printer of claim 15, said at least one controller causing, in said torque control mode, any one of a varying level of torque to be applied to said one of said first sheet transport device and said third sheet transport device and a varying level of power to be supplied to said one of said first sheet transport device and said third sheet transport device so that a desired level of sheet tension is maintained at said second sheet transport device.

20. The printer of claim 15, said at least one controller further controlling said one of said first sheet transport device and said third sheet transport device comprising using a transition control mode when transitioning from said velocity control mode to said torque control mode and further when transitioning from said torque control mode to said velocity control mode.

21. The printer of claim 15, said first sheet transport device comprising a registration device, said second sheet transport device comprising an image transfer device and said third sheet transport device comprising an image fixing device.

22. A printer comprising:

multiple sheet transport devices transporting a print media sheet along a sheet transport path, said sheet transport devices comprising a first sheet transport device, a second sheet transport device and a third sheet transport device in series; and at least one controller performing the following:

controlling said first sheet transport device as said first sheet transport device receives a print media sheet and transports said print media sheet to said second sheet transport device, said controlling of said first sheet transport device comprising alternatingly using a velocity control mode and a torque control mode;

controlling said second sheet transport device as said second sheet transport device receives said print media sheet from said first sheet transport device and transports said print media sheet to said third sheet transport device, said controlling of said second sheet transport device comprising solely using said velocity control mode; and controlling said third sheet transport device as said third sheet transport device receives said print media sheet from said second sheet transport device and further transports said print media sheet, said controlling of said third sheet transport device comprising alternatingly using said torque control mode and said velocity control mode.

23. The printer of claim 22, said at least one controller controlling said first sheet transport device using said velocity control mode, when said print media sheet is not engaged by said second sheet transport device, and using said torque control mode, when said print media sheet is concurrently engaged by both said first sheet transport device and said second sheet transport device, said at least one controller controlling said second sheet transport device using said velocity control mode, when both said second sheet transport device and said first sheet transport device concurrently engage said print media sheet and when both said second sheet transport device and said third sheet transport device concurrently engage said print media sheet, and said at least one controller controlling said third sheet transport device using said torque control mode, when said print media sheet is concurrently engaged by both said second sheet transport device and said third sheet transport device, and using said velocity control mode, when said print media sheet is not engaged by said second sheet transport device.

* * * * *